United States Patent [19]

Koppenberg

[11] Patent Number: 4,566,668

[45] Date of Patent: Jan. 28, 1986

[54] APPARATUS FOR CASTING CONCRETE

[76] Inventor: Bruce G. Koppenberg, 9674 Mt. Baker Hwy., Deming, Wash. 98244

[21] Appl. No.: 594,539

[22] Filed: Mar. 29, 1984

[51] Int. Cl.[4] ..... B28B 7/18; B28B 7/28

[52] U.S. Cl. ..... 249/60; 249/167; 249/176

[58] Field of Search ..... 249/60, 70, 71, 72, 249/69, 176, 122, 123, 124, 136, 64, 167, 177

[56] References Cited

U.S. PATENT DOCUMENTS

| | | | |
|---|---|---|---|
| 720,536 | 2/1903 | Seamans | 249/122 |
| 762,250 | 6/1904 | Porter | 249/122 |
| 1,439,281 | 12/1922 | Ambursen | 249/176 |
| 1,623,560 | 4/1927 | Sherman | 249/64 |
| 1,702,253 | 2/1929 | Elliot | 249/136 |
| 2,544,602 | 3/1951 | Kosorotoff | 249/176 |
| 3,192,567 | 7/1965 | Abernethy et al. | 425/123 |
| 3,314,638 | 4/1967 | Morrison | 249/176 |
| 3,360,230 | 12/1967 | Clements et al. | 249/176 |
| 3,543,458 | 12/1970 | Guritz | 249/176 |
| 3,632,078 | 1/1972 | Dashew | 249/176 |
| 3,931,952 | 1/1976 | Dashew | 249/177 |

*Primary Examiner*—Jay H. Woo
*Assistant Examiner*—James C. Housel
*Attorney, Agent, or Firm*—Kolisch, Hartwell & Dickinson

[57] ABSTRACT

Form apparatus for casting concrete. It includes a platform having a work-supporting upper face, and plural, hollow box-like tub molds distributed over the platform. Each mold has a perimeter flange adjacent its base and projecting outwards from the sides of the mold. A lattice frame paralleling and supported by the platform contains plural openings, and each opening snugly receives bottom margins of the sides of a mold. The lattice frame positions the molds on the platform with the perimeter flanges of the molds disposed between the lattice frame and the platform. A knockdown encompassing frame with sides extends upwardly from adjacent the periphery of the lattice frame forming a concrete-leakage inhibiting seal between the sides and the lattice frame. The apparatus provides portable apparatus for casting a multi-niche columbarium module close to a burial site.

5 Claims, 8 Drawing Figures

FIG. 2
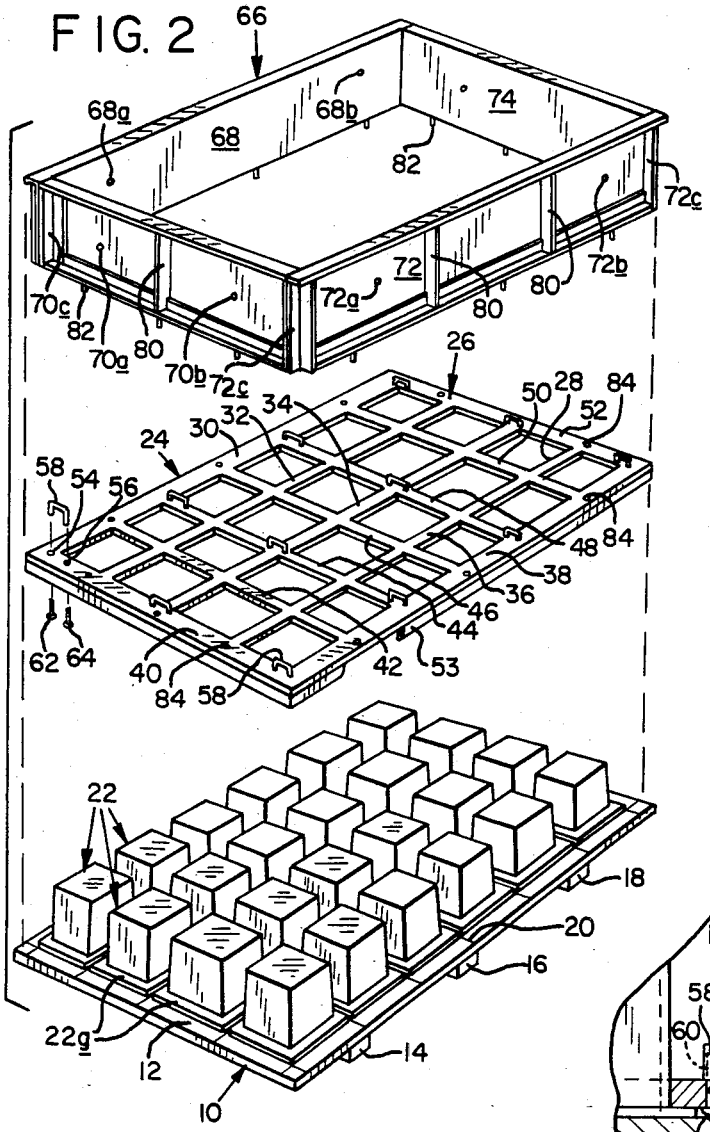
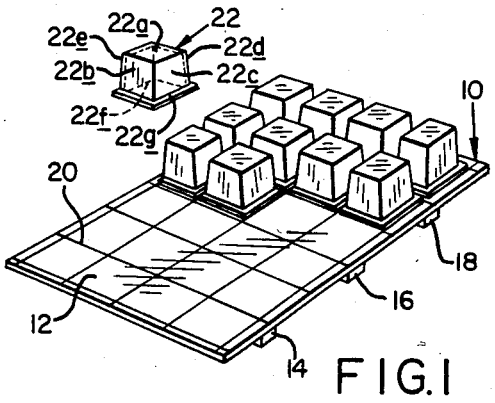
FIG. 1
FIG. 4
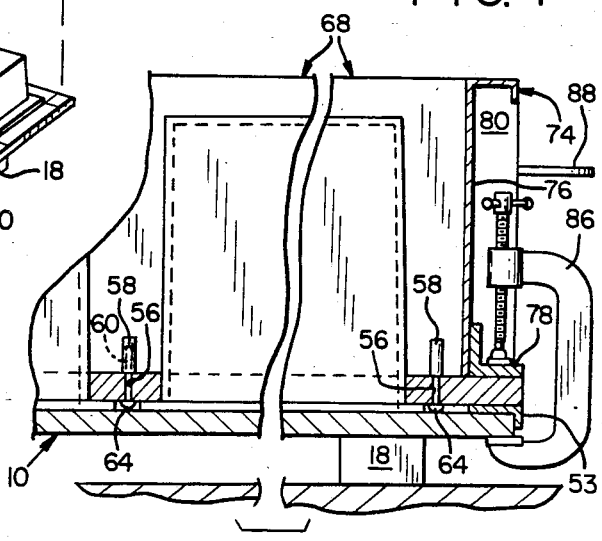
FIG. 3
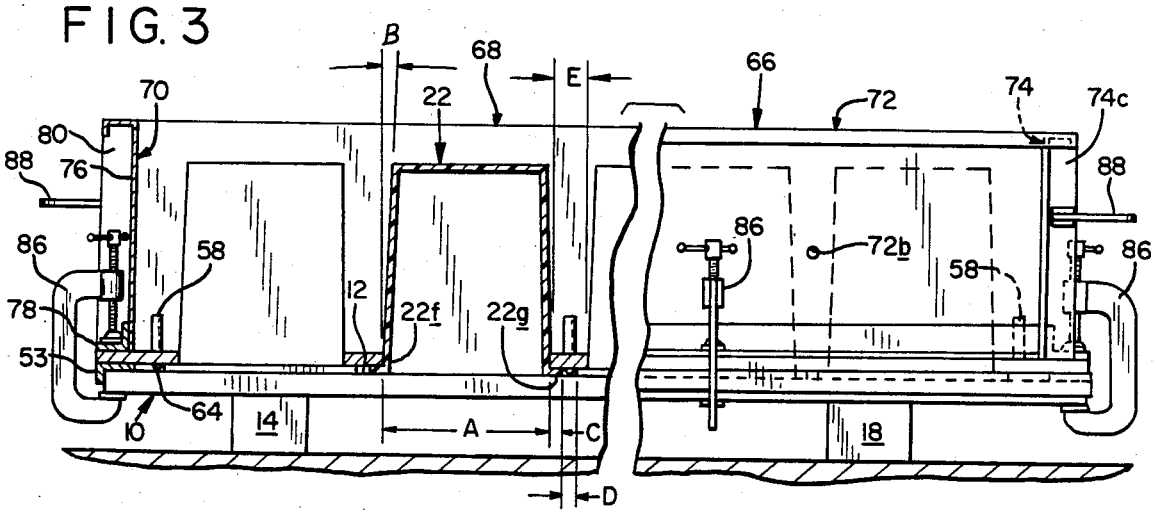

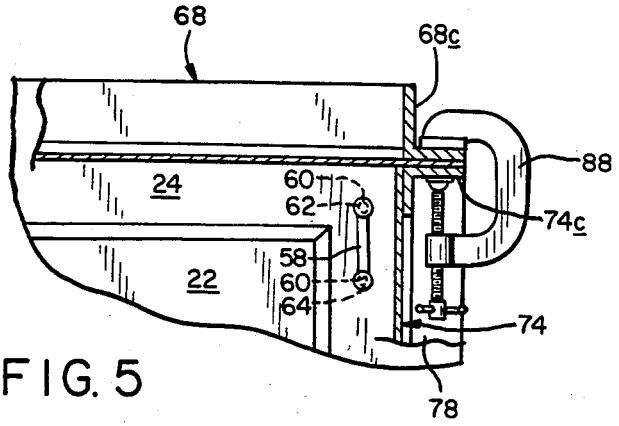
FIG. 5
FIG. 6
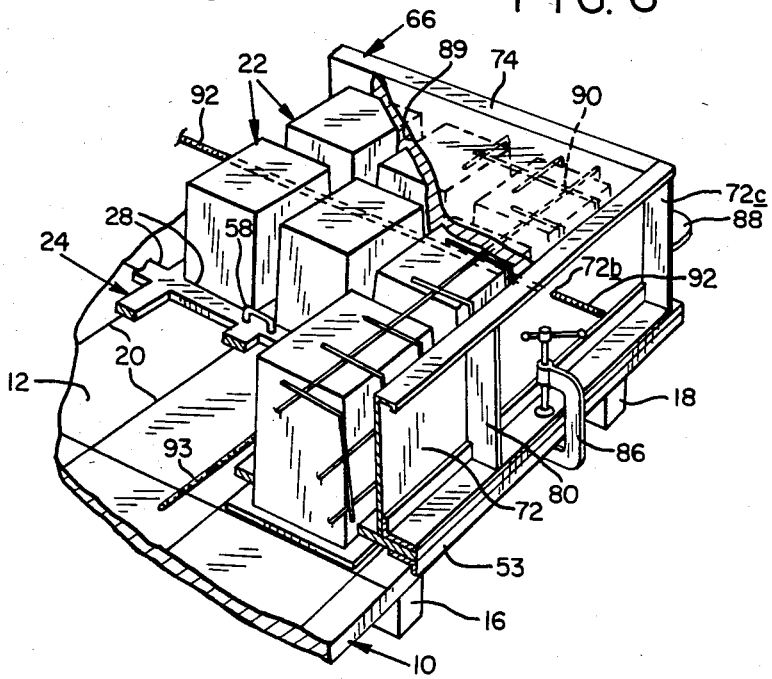
FIG. 7
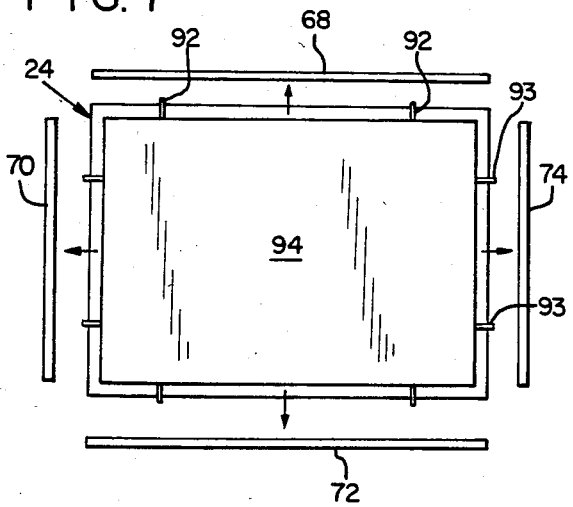
FIG. 8
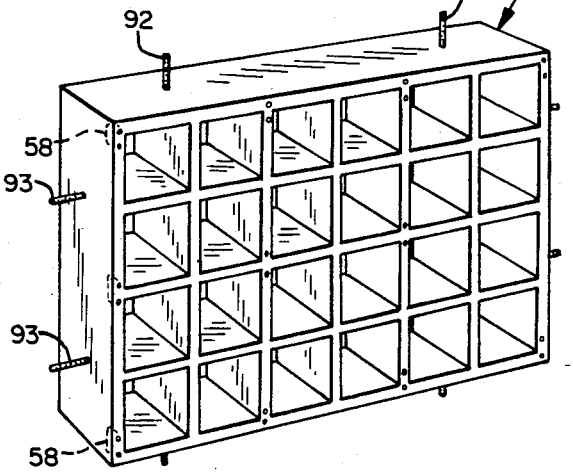

APPARATUS FOR CASTING CONCRETE

BACKGROUND AND SUMMARY OF THE INVENTION

This invention relates to an apparatus for casting concrete. More particularly, the apparatus of this invention is adapted for the casting of an integral concrete structure featuring recesses or niches indented into the concrete structure from one side thereof.

The form apparatus of the invention is particularly adapted for the casting of columbarium modules, which are vault-like units lined with recesses or niches adapted for reception of cinerary urns containing the cremated remains of the decreased. Columbarium units have been manufactured by building the structure from component side walls, rear walls, shelves, and then sealing the components together to form a completed structure. This form of construction is both time consuming and labor intensive.

Modular columbarium units may be produced by using the apparatus of the instant invention to form a integral concrete structure in which side walls, a rear wall, and shelves are integrally formed, reinforced, and provided with means for joining multiple units together. Modular columbarium units may be produced by using the apparatus in the invention which may be arranged in various ways, as by placing the units end-to-end, placing the units back-to-back, or stacking the units to produce a complete mausoleum type structure. The form apparatus itself is easily dismantled, and while possessing requisite rigidity when assembled, is made up of component parts that on disassembly are relatively light and easily transported. Thus, the apparatus may be readily employed for the production of poured-in-place units, or for the production of pre-cast units, prepared for shipment to the site of final installation. The modules so produced are adapted to remain intact, whether positioned as a solitary unit or joined to other modules, should the modules be installed in an area which is subject to earth tremors.

An object of the invention is to provide form apparatus for casting a modular concrete columbarium unit which is usable with the expenditure of relatively few man hours to produce a unitary concrete structural module with niches or recesses indented inwardly from one face of the module.

Another object is to provide form apparatus which is readily removed from the concrete structure after casting.

Yet another object is to provide form apparatus which is readily disassembled and when in a disassembled state is made up of relatively easily moved components.

A related object is to provide such form apparatus which is extremely versatile in use, and readily modified to produce columbarium units of different configurations.

The apparatus of the instant invention includes a platform having a work-supporting upper face, plural box-like molds each having a top, sides and a base, the molds being distributed over the platform over with their bases facing against the platform. A lattice frame parallels and is supported by the platform, and this includes a planar element with plural openings extending therethrough, each opening snugly receiving bottom margins of the sides of a mold. The lattice frame acts to position the molds on the platform. A knock-down encompassing frame with sides extends upwardly from the periphery of the lattice frame, and a concrete-leakage inhibiting seal is established between the sides of the encompassing frame and the lattice frame. The lattice frame includes multiple expanses, paralleling and laterally spaced from each other extending in one direction in the frame, and other set of elongated expanses laterally spaced from each other and extending transversely of the first set of expanses. The two sets of expanses are joined to each other and form a flush surface on which is referred to as the upper side of the lattice frame. The expanses cooperate to form openings in the frame through which the molds are received. Means are provided in the lattice frame for positioning anchors in the finished concrete structure, which anchors provide a means of attaching a marble or concrete cover over the open side of the niches formed the module.

These and other objects and advantages are obtained by the invention, which will now be described in conjunction with the accompanying drawings.

DESCRIPTION OF THE DRAWINGS

FIG. 1 is a perspective view, of a platform with plural molds distributed thereon.

FIG. 2 is an enlarged exploded perspective view of form apparatus constructed according to the invention.

FIG. 3 is a side elevation of form apparatus with portions broken away to show detail.

FIG. 4 is an enlarged sectional view of form apparatus with portions broken away to show detail.

FIG. 5 is a top plan view of an end joint of a knock-down encompassing frame.

FIG. 6 is a perspective view of form apparatus with concrete poured therein, partially broken away to show detail.

FIG. 7 is a top view depicting removal of a knock-down encompassing frame.

FIG. 8 is a perspective view of a finished cast concrete columbarium module formed through the use of the instant invention.

DETAILED DESCRIPTION OF THE PREFERRED EMBODIMENT

Turning initially to FIG. 1, a platform 10 with a work-supporting upper face 12 is supported on risers 14, 16 and 18. The risers support platform 10 above a floor or ground level, thereby providing limited access to the underside of the platform.

Upper face 12 has a tub positioning grid 20 delineated thereon. The grid, in the preferred embodiment, is arranged such that a four-by-six matrix is defined.

Plural, hollow box-like tub molds, shown generally at 22, are distributed over at the platform. Each mold has a top 22*a*, four sides, 22*b*, 22*c*, 22*d*, an 22*e*, an open square base 22*f*, and a perimeter flange 22*g* which is adjacent the base and integrally formed with the sides of the mold. flange 22*g* projects outward from the sides of the tub mold. The molds are distributed over the upper face of the platform with their bases facing against the platform. The molds in a typical embodiment are made from a light-weight plastic material.

The lines of grid 20 have a predetermined thickness, thereby indicating desired separation between the flanges of one mold and the flanges of adjacent molds.

Turning momentarily to FIG. 3, a tub mold is shown in cross-section at 22. The distance between the outer sides of the mold, in a typical embodiment, as shown by dimension A, is approximately 8 inches. The mold has a slight taper from its base to its top, indicated by dimension B, which is provided to facilitate easy removal of the mold from the completed concrete structure. Flange 22*g* extends about the periphery of base 22*f*, and projects outward of the side a distance of approximately three-eights of an inch, shown by dimension C. The molds are placed on surface 12 with a spacing of approximately one-half inch between their flanges, as shown by dimension D. This spacing provides a distance of one-and-one-quarter inch, shown at E, between the bottom margins the sides of the individual molds, and results in a one-and-one-quarter inch thick wall between the niches ultimately formed in the module. Of course, molds of other dimensions may be used, to form columbarium modules with different sized niches therein.

Turning now to FIG. 2, platform 10 is shown with twenty-four tub molds, as exemplified by mold 22, in position. A lattice frame 24 is shown above platform 10 and tub molds 22. Lattice frame 24 includes a planar element, shown generally at 26, which has plural openings, as exemplified by that shown at 28, which extend through element 26.

Considering specific details of the construction of lattice frame 24, the frame includes a first set of multiple elongated expanses 30, 32, 34, 36 and 38, extending longitudinally in the panel, paralleling and laterally spaced from each other. A second set of elongated expanses 40, 42, 44, 46, 48, 50 and 52 are parallel to, and laterally spaced from each other, and extend transversely of the first set of expanses. The two sets of expanses are joined together and form a flush surface on what is referred to as the upper side of lattice frame 24. Openings, such as opening 28, are formed in lattice frame 24 by the two sets of elongated expanses. Each openings snugly receives a bottom margin of the sides of a mold. A rim, 53, which maybe formed of angle iron, is affixed about the periphery of the lattice frame and extends over the edges of platform 10. The lattice frame acts to position the molds accurately on the platform.

Referring now to FIGS. 2, 3 and 4, in a typical embodiment, expanses 40, 44, 48 and 52 contains bores, such as those shown at 54, 56 in expanse 40. The bores are provided to 24. Referring to FIG. 4, the anchor members have internally threaded bores 60 into which detachable fasteners, such as bolts 62, 64 are inserted, thereby holding the anchor members in place against the upper surface of lattice frame 24. The anchor members project upwards from the upper surface of frame 24 and will be retained in the finished module.

A knockdown encompassing frame is shown generally at 66. Encompassing frame 66 has sides 68, 70, 72 and 74. Referring to FIG. 4, the sides of encompassing frame 66, as exemplified by side 74, include a formed metal plate 76, which is formed of 12 gauge sheet metal in a typical embodiment, and a section of angle iron 78 which is secured to plate 76 as by welding. Additionally, and now referring to FIG. 2, the sides have reinforcement members such as those shown at 80, attached to the sides intermediate their ends. In a typical embodiment, each side has a pair of lift rod holes, such as 72*a*, 72*b* which allow insertion of lift rods.

The sides of the encompassing frame have alignment pins 82 which fit into alignment bores 84 on lattice frame 24. The alignment pins provide accurate placement of the encompassing frame sides over the lattice frame. The encompassing frame thus overlies the lattice frame around the periphery of the lattice frame.

Referring again to FIG. 4, the periphery of the assembled form is shown. Clamps, as that shown at 86 are used to tightly hold the encompassing frame to the lattice frame, thereby establishing a concrete-leakage inhibiting seal between the sides and the lattice frame.

Referring now to FIG. 5, details of the ends of encompassing frame sides, such as side 68 and side 74 are shown. The end of side 68 has a section of angle iron 68*c* attached to it, as by welding. Side 74 includes an angle iron portion 74*c* it, as by welding. Side 74 includes an angle iron portion 74*c* attached to its end, as by welding. Additional clamps, such as that shown at 88, are used to secure the sides of the encompassing frame to one another at the corners of the frame, thereby establishing a seal which prevents concrete-leakage.

OPERATION OF A FORM APPARATUS

A modulator columbarium unit is formed by assembling the components of a form apparatus constructed according to the invention and pouring concrete over the tub molds within the bounds of the encompassing frame.

Initially, the outer surfaces of the tub molds, the upper surface of the lattice frame, and the inner surfaces of the encompassing frame are oiled to facilitate removal of the forms from the poured concrete structure. Once the lattice frame has been oiled, the anchor members are secured by means of removable fasteners.

The oiled tub molds are distributed on the platform as has been shown in conjunction with FIGS. 1, 2 and 3. The lattice frame is lowered over the platform and the tub molds, such that the tub molds project through openings 28 in the lattice frame. Each opening snugly receives the bottom margins of the tub molds thereby accurately positioning the molds on the platforms. Lattice frame rim 53 is lowered over the edge of the platform 10 to prevent movement of the tub molds and the lattice frame relative the platform.

The sides of encompassing frame 66 are positioned overlying the lattice frame about the periphery of the lattice frame, and clamps are interposed between the encompassing frame and the lattice frame to establish a concrete-leakage inhibiting seal.

With the form apparatus complete, pouring of concrete, shown at 89, may begin. Initially, and referring now to FIG. 6, concrete is poured into the encompassing frame to the level of the lift rod holes. The poured concrete is vibrated to remove air bubbles from the mix. A section of reinforcement mesh 90 is placed along frame sides 72 and 68. The mesh extends along what will ultimately be the top and bottom surfaces of the finished module and is bent to partially extends along frame sides 70 and 74, along what will become the sides of the completed module.

Once the reinforcement mesh is in place, lifting rods, such as that shown at 92 are inserted through the lifting rod holes. Lifting rods may be inserted such that they extend parallel to expanse 42 and 50, and, if the module is intended to be joined to other modules at its sides, lifting or joining rods 93 may be inserted to extend parallel to expanses 32 and 36. The lifting rods are cut to extend five to six inches beyond the sides of the encompassing frame.

The pour is continued to fill the form with concrete and to provide an upper surface which will ultimately become the back side of the completed module. The back side of the module should have a thickness of approximately one inch. The concrete should extend above the level of the tub molds therefore by one inch. This distance may be easily determined by forming the sides of the encompassing frame to extend one inch over the tops of the tub molds. The poured concrete may then be leveled across the exposed encompassing frame sides.

When the pour is complete, and the concrete has had an opportunity to cure, the clamps are removed from the encompassing frame sides, and the sides removed over the end of the lifting rods, as shown in FIG. 7.

The module, with the lattice frame still attached, is raised to an upright position with the module and the lattice frame being supported on blocks. The tub molds may now be removed from the module, as by prying with a claw hammer or crow bar, or by forcing air under pressure around the outer periphery of the molds.

Once the tub molds have been removed from the module, the fasteners may be removed from the anchor members, and the module separated from the lattice frame. A completed module 94 is shown in FIG. 8.

Individual modules may be positioned back-to-back, forming a doubled sided columbarium, or the modules may be joined end-to-end, utilizing rods 93, projecting from the ends of the modules to secure adjoining module together. This form of joining is particularly suited to areas which are subject to earth tremors. Additionally, the modules may be stacked on top of one another to form a columbarium of greater height. To accomplish this, lifting rods 92 on the tops and bottoms of adjoining module are secured to each other.

Columbarium modules with different numbers of niches may be formed by varying the size of the apparatus, or the number or size of the molds.

While a preferred embodiment of the form apparatus has been described, it is to be understood that variations and modifications may be made to the form of the structure without departing from the spirit of the invention.

It is claimed and desired to secure by Letters Patent:

1. Apparatus for casting concrete comprising a platform element adapted to be supported on the ground having a work-supporting essential non-perforate upper face, plural box-like molds each having a top, sides and a base, said molds being distributed over said platform element with their bases facing against said upper face of said platform element, a lattice frame paralleling and supported by the platform element comprising a planar element with plural openings extending therethrough, each opening snugly receiving bottom margins of the sides of a mold, said lattice frame further positioning said molds on the platform element, each mold comprising a tub mold having a perimeter flange adjacent its base integral with the sides of the mold and projecting outwardly from the mold sides, said flange disposed between the lattice frame and the platform element, and a knockdown encompassing frame with sides extending upwardly from adjacent the periphery of said lattice frame, said encompassing frame overlying said lattice frame around the periphery of the lattice frame, and clamps securing the encompassing frame, the lattice frame, and the platform element together, thereby establishing a concrete-leakage inhibiting seal between said lattice frame and the encompassing frame and between the base of the tub molds and the lattice frame.

2. The apparatus of claim 1, wherein said encompassing frame is positioned on the lattice frame with pins interconnecting the two.

3. Apparatus for casting concrete comprising a platform having a work-supporting upper face, plural molds each having a top, sides and a base and a perimeter flange adjacent said base integral with said sides and projecting outwardly from said sides, said molds being distributed over said platform with their bases facing against said platform, a lattice frame paralleling and supported by the platform comprising a planar element with plural openings extending therethrough, each opening snugly receiving bottom margins of the sides of a mold and said lattice frame resting on the perimeter flanges of said molds, said lattice frame further positioning said molds on the platform, wherein said lattice frame includes multiple elongate expanses, paralleling and laterally spaced from each other extending in one direction in the frame, and a second set of multiple elongate expanses paralleling and laterally spaced from each other extending transversely of said first set and joined therewith, said expanses forming a flush surface on the upper side of said lattice frame, said sets of expanses forming said openings in said frame, wherein certain of said expanses have bores extending therethrough, anchor members having internally threaded bores positioned against said expanses with said anchor members extending upwardly from said upper side of the frame, detachable fasteners projecting through said bores in the expanses and screwed into the threaded bores of the anchor members holding the anchor members in place, and a knockdown encompassing frame with sides extending upwardly from adjacent the periphery of said lattice frame, said encompassing frame overlying said lattice frame around the periphery of the lattice frame, and clamps securing the encompassing frame, the lattice frame, and the platform together, thereby establishing a concrete-leakage inhibiting seal between said lattice frame and the encompassing frame and between the base of the tub molds and the lattice frame.

4. The apparatus of claim 7, wherein said molds are generally hollow box-like tub molds, each having an open base and otherwise substantially closed, each tub mold having a perimeter flange adjacent its base integral with the sides of the mold and projecting outwards from the sides and disposed between the lattice frame and the platform.

5. Apparatus for casing concrete comprising a platform element adapted to be supported on the ground having a work-supporting upper face, plural hollow box-like tub molds each having a top, sides and a base, said molds being distributed over said platform element with their bases facing against said upper face of said platform element, each mold having a open base and otherwise being substantially closed, each mold having a perimeter flange adjacent its base integral with the sides of the mold and projecting outwards from the sides, a lattice frame paralleling and supported by the platform element comprising a planar element with plural openings extending therethrough, each opening snugly receiving bottom margins of the sides of the mold and said lattice frame resting on the perimeter flanges of said molds, said lattice frame further positioning said molds on the platform element, and a knockdown encompassing frame with sides extending upwardly from adjacent the periphery of said lattice frame and clamps securing the encompassing frame through the lattice frame to the platform element with a concrete-leakage inhibiting seal established between the lattice frame and the encompassing frame and between the base of the tub molds and the lattice frame.

* * * * *